United States Patent [19]

Hendriks

[11] Patent Number: 4,533,293

[45] Date of Patent: Aug. 6, 1985

[54] METHOD OF IMPROVING THE PART-LOAD BEHAVIOR OF A TURBO MACHINE, AND A COMPRESSOR OR PUMP ADAPTED FOR USE OF SUCH METHOD

[75] Inventor: Rudolf Hendriks, Velp, Netherlands

[73] Assignee: Thomassen International, Netherlands

[21] Appl. No.: 452,022

[22] Filed: Dec. 21, 1982

[30] Foreign Application Priority Data

Dec. 22, 1981 [NL] Netherlands ..... 8105790

[51] Int. Cl.[3] ..... F04D 29/68

[52] U.S. Cl. ..... 415/117; 415/53 R

[58] Field of Search ..... 415/52, 53 R, 11, 12 D, 415/DIG. 1, 116, 117, 1

[56] References Cited

U.S. PATENT DOCUMENTS

| | | | |
|---|---|---|---|
| 2,798,658 | 7/1957 | McDonald | 415/53 |
| 2,825,532 | 3/1958 | Kadosch et al. | 415/DIG. 1 X |
| 3,032,313 | 5/1962 | Szydlowski | 415/DIG. 1 X |
| 3,305,165 | 2/1967 | Gregory | 415/120 X |
| 3,390,545 | 7/1968 | Hoffman | 62/510 |
| 3,643,675 | 2/1972 | Wetterstad | 137/13 |
| 3,922,108 | 11/1975 | Benisek | 415/116 |
| 3,941,499 | 3/1976 | Kronogard | 415/120 X |
| 3,957,389 | 5/1976 | Rafferty et al. | 415/1 |
| 4,228,753 | 10/1980 | Davis et al. | 415/DIG. 1 X |

FOREIGN PATENT DOCUMENTS

| | | | |
|---|---|---|---|
| EP72701 | 2/1983 | European Pat. Off. | 415/53 R |
| 997863 | 7/1965 | United Kingdom | 415/53 R |
| 739257 | 6/1980 | U.S.S.R. | 415/DIG. 1 |

*Primary Examiner*—Everette A. Powell, Jr.

*Attorney, Agent, or Firm*—Klarquist, Sparkman, Campbell, Leigh & Whinston

[57] ABSTRACT

The invention relates to a method of improving the part-load behavior of a turbo machine operating with a rotor 13 having fixed vanes 14. Such method uses the feature of applying auxiliary fluid injection nozzles 18 near the inlet 11 of the rotor for adding a small amount of fluid to the main fluid flow.

The additional amount of fluid is projected in direction such that a substantial velocity component of the movement of this additional fluid is directed tangentially with respect to the rotation of the rotor 13.

9 Claims, 5 Drawing Figures

METHOD OF IMPROVING THE PART-LOAD BEHAVIOR OF A TURBO MACHINE, AND A COMPRESSOR OR PUMP ADAPTED FOR USE OF SUCH METHOD

BACKGROUND OF THE INVENTION

In the operation of a turbo machine attempts have been made to remain within the so-called stable area and, in particular, not to cross the boundary line with the unstable area. This boundary line is also known as the stalling limit and in practice is frequently referred to as the surge line. In that case a strong areodynamic pulsation occurs, which may cause mechanical damage to the turbo machine. A turbo machine is always so designed as to function amply within the stable area. However, in a turbo machine it is often impossible to avoid crossing the boundary line between the stable and unstable area when the quantity of fluid flowing through the machine is reduced.

DESCRIPTION OF THE PRIOR ART

Efforts have already been made to obviate these deficiencies. For example, it is known to dispose a so-called blow-off valve at the turbo machine exit side. The effect of blowing off some of the fluid flowing through the machine is that the machine handles more fluid than is really required at that time, but this offers the possibility of the turbo machine continuing to operate in the stable area but with a lower efficiency.

Another method of influencing the flow of a fluid inside a machine is to take steps to shift the boundary line between the stable and unstable area. These steps consist, for example, of using adjustable guide vanes at the machine inlet. The effect of this in principle is that the relative angle of the fluid to the machine is kept constant even with varying quantities of fluid, the constant angle being at the value selected during the design of the machine. A disadvantage of this method, which is also known as "variable geometry"is that the construction is fairly expensive and complex.

SUMMARY OF THE INVENTION

It is a primary object of the present invention to provide a method of influencing the flow of fluid inside a machine, in which a displacement and a pressure increase of the fluid are effected by means of at least one rotor, without it being necessary to use either of the steps described hereinbefore. In the method according to the invention as applied to a compressor for gaseous fluid or a pump for liquid fluid, these objects are obtained by means of a controllable extra quantity of gas in the order of 0.1 to 5.0% of the main flow of fluid which is fed along a number of supply points annularly disposed in the supply of fluid for compression or pumping, in the mainly radially directed inlet flow to the rotor, a substantial velocity component of the movement of the extra fluid supplied being directed tangentially to the rotor rotation. Consequently, the inlet flow will locally obtain a certain tangential velocity component.

Since the extra fluid injection takes place on a radius larger than the radius of the rotor inlet, the tangential velocity component will increase, on the basis of the free vortex principle, as the inlet flow progresses toward smaller radii. Finally, the inflow angle of the fluid at the rotor inlet will be considerably influenced only a slight momentum (extra fluid injection) being required for the purpose. The object of influencing the flow is to cause the velocity at which the flow meets the rotor to so deviate from the axial direction (either in the direction of the rotor circumferential velocity: co-rotation, or in opposition thereto: counter-rotation) that the relative inflow velocity has a direction which makes stable operation possible at a lower mass flow than is permissible according to the original position of the surge line.

The new method, which can be characterised by the term "vortex control", must not be confounded with the method of air injection into the axial inlet of a compressor, since in known methods no use is made of the reinforcing effect of the difference in radius between the site of the fluid injection and the rotor inlet on the tangential velocity component of the feed flow, as is indeed the case in the method according to the invention. The invention also enables the thermal loading of the turbine to be reduced during the start cycle.

The invention is also embodied in a turbo machine for using the above-described method, comprising a housing provided with an inlet and outlet, at least one driven rotor provided with vanes in said housing, by means of which a flow of fluid is displaced from the inlet inside the housing, and then brought to a higher pressure level, and is finally discharged via the outlet means being provided in the region of the inlet for the directed supply of extra fluid to the flow to the rotor. According to the invention in such a turbo machine the means for the supply of fluid consist of nozzles disposed concentrically with respect to the rotor center-line.

The inlet section of the housing often contains a number of struts disposed transversely of the gas flow. In that case, nozzles are formed by openings in feed conduits connected to the outlet (delivery side) of the compressor or pump and which are disposed on a smaller radius and paralel to said struts. In addition, it is sometimes possible to use hollow struts, provide them with nozzles, and connect them to the compressor outlet.

The features of the present invention which are believed to be novel are set forth with particularity in the appended claims.

Other claims and many of the attendant advantages will be more readily appreciated as the same becomes better understood by reference to the following detailed description and considered in connection with the accompanying drawings in which like reference symbols designate like parts throughout the figures.

DESCRIPTION OF THE PREFERRED EMBODIMENTS

Figure 3:
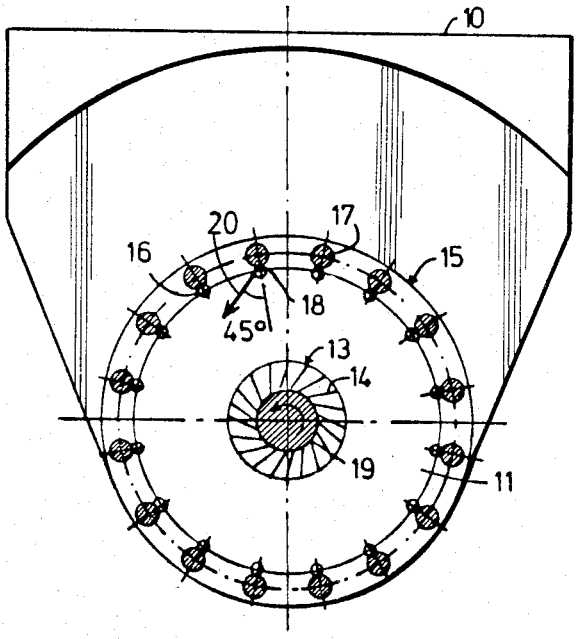
FIGS. 3 and 4 are a simplified cross-section and longitudinal section respectively through a radial compressor with FIG. 3 being a vertical section view along III—III of FIG. 4.
Figure 4:
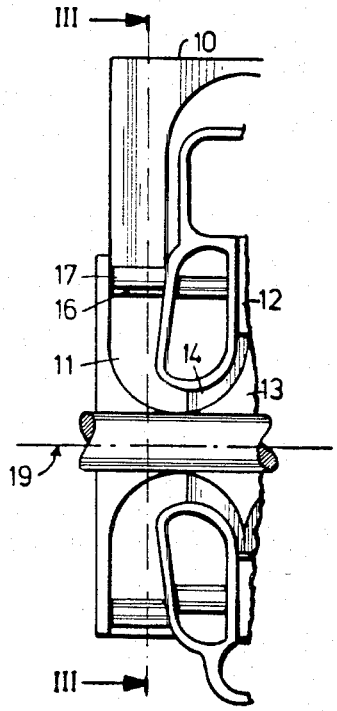
Figure 5:
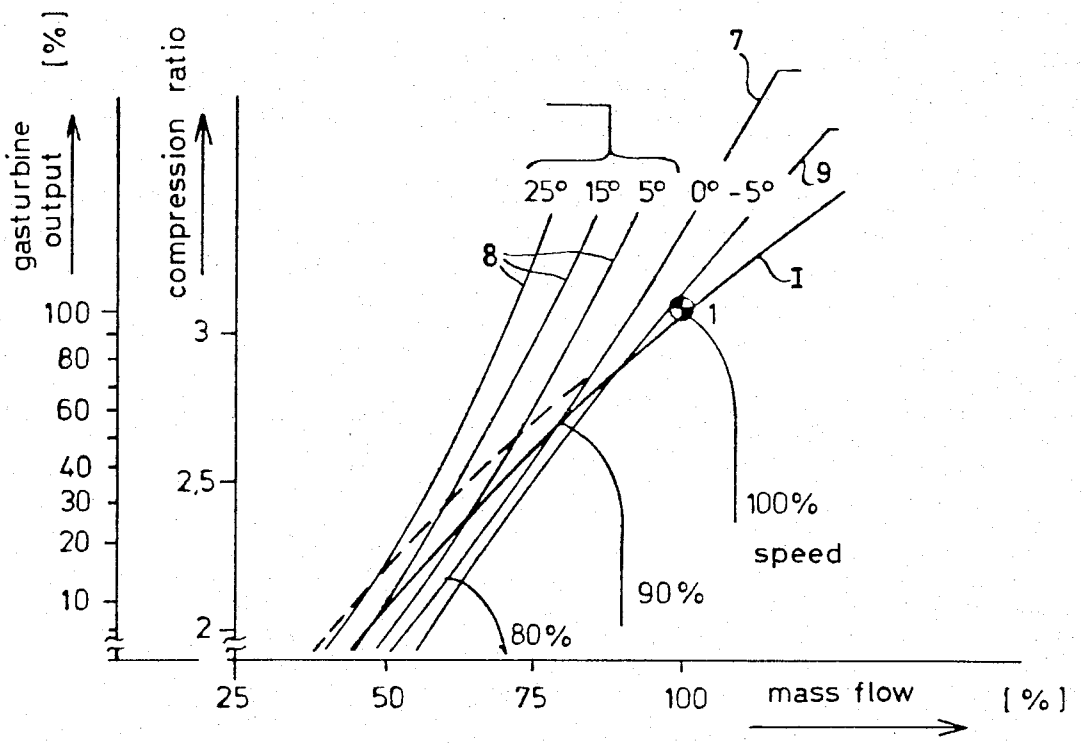

FIG. 5 ia a graph showing the results of calculations based on measurements on a static model of a compressor according to FIGS. 3 and 4. The calculations are combined with measured compressor characteristics.

Figure 1:
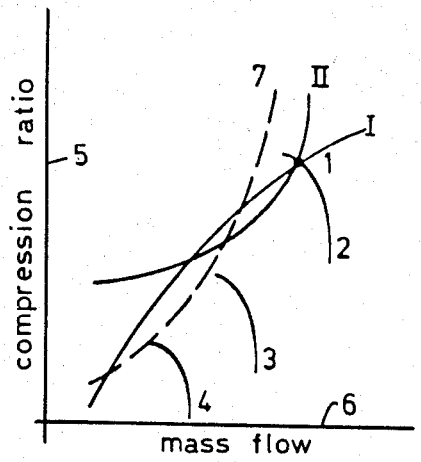
FIGS. 1 and 2 are graphs showing the characteristics of a compressor.

Referring now to FIG. 1 the operating lines I and II for gas turbine use (I) or use as a process compressor (II) respectively, start at the so-called design point 1 at full load. The curves 2, 3, 4 show the conventional compressor characteristics at full load, part-load (±50%) and part-load (±20%) respectively. The compression ratio is plotted along the vertical axis 5 while the mass flow is plotted along the horizontal axis 6. This graph includes a broken line 7 illustrating the stalling boundary, i.e. the boundary between the stable and unstable areas. Line 7 is also known as the surge line in practice.

Figure 2:
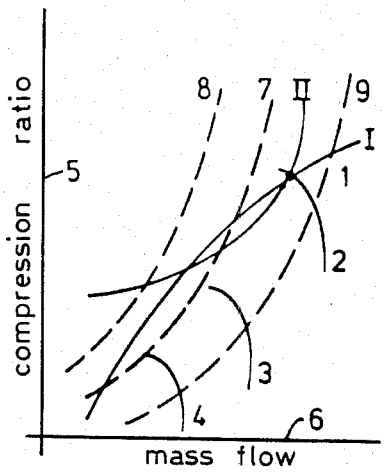

It will be clear from the said graph that the stalling limit is reached even on a reduction of up to ±75% of the mass flow. According to the invention, the curve of the surge line 7 is so influenced that it will at all times remain on the left-hand side of the operating lines I and II of the turbo machine (see FIG. 2) without the distance from the operating line being excessive. This is achieved by supplying a very small quantity of extra fluid to the inlet flow to the machine rotor. This supply is so effected that a small extra momentum is imparted to the inlet flow in the tangential direction. This can be done both in the same and opposite direction to the inlet flow, the effect being shown by surge line 8 and surge line 9, respectively, in FIG. 2.

Referring now to FIGS. 3 and 4 a method is illustrated of achieving this. These figures show a turbo machine in the form of an air compressor comprising a housing 10 with an inlet 11 and an outlet 12. Inside the housing 10 is a driven rotor 13 provided with fixed vanes 14 by means of which a flow of fluid is displaced from the inlet 11 inside the housing 10, and then brought to a higher pressure level and is finally discharged via outlet 12 (FIG. 4). In the region of the inlet 11, injection means 15 are provided for injecting a directional supply of extra fluid to the flow to the rotor 13 such as a long line 20. To this end, hollow feed conduits 16 are used, which are disposed in a ring transversely to the gas flow and parallel to the struts 17. These hollow feed conduits 16 are formed with gas nozzles 18 provided by openings in such feed conduits and which include an angle with the fluid flowing therealong. Feed conduits 16 are disposed concentrically with respect to the center-line 19 of the shaft of the rotor 13. The gas supply to the conduits 16 is via a connection (not shown) to the outlet 12 of the turbo machine, in this case a compressor.

Referring now to FIG. 5 the results are illustrated of calculations based on measurements taken at the inlet side 11 of a compressor corresponding to FIGS. 3 and 4. These measurements are taken along the periphery of the pitch circle, the flow angles being measured in a condition without and with gas injection. The difference between the values provides the angle offset. It has been found that an average angle offset of 5° to 10° is obtained by an injection with gas up to a quantity of 1%–2% of the main flow. An overpressure of 800 mm water column is used.

In the event of the compressor forming part of a gas turbine, FIG. 5 also shows the operating line I and the design point 1 of the compressor. The notation 0° denotes the surge line without gas injection. The notations 5°, 15° and 25° show the lines at which co-rotation is obtained with respect to the 0° line of the associated magnitude. The notation −5° shows the line at which a counter-rotation with respect to the 0° line is obtained. These notations are based on the rotor inflow condition on the pitch circle diameter. As a result of the associated rotation, the surge line 6 will, for example, shift as indicated by a break in the associated line 7.

It is also illustrated that in the event of use in a gas turbine the method according to the invention must be used at part-load operation below 75% of the gas turbine output and a co-rotation of 20° is required at a 20% output (vide FIG. 5).

Tests have shown that the required co-rotation or counter-rotation in order to shift the surge line 7 to the left or right in the graph is all the more effective the higher the compressor compression ratio. It should also be noted that the method according to the invention can also be used for a compressor required to deliver a constant pressure under varying mass flow. The invention is also applicable and in principle of use for both liquid and gaseous media.

What is claimed is:

1. A turbo machine adapted for use as a compressor or a pump, comprising:

a housing provided with an inlet and an outlet;

at least one driven rotor provided with rotor vanes in said housing, by means of which a free vortex flow of fluid is displaced in a path from the inlet to the rotor vanes without deflection by other vanes in said path, and then brought to a higher pressure level, and is finally discharged from the housing through the outlet; and injection means provided in the region of the inlet for injecting extra fluid into the path of fluid from the inlet to the rotor, said injection means including a plurality of nozzles disposed in an annular array positioned concentrically with respect to the axis of the rotor at a greater distance than said rotor vanes from said axis, at least the majority of said nozzles being spaced substantially the same distance from said axis.

2. A machine according to claim 1, in which a number of struts are disposed transversely to the flow in the inlet section of the housing spaced about the axis of the rotor, and the nozzles are formed by openings in feed conduits connected to the outlet (delivery side) of the rotor and which are disposed in spaced relationship about the axis of the rotor on a smaller radius than the struts and parallel to said struts.

3. A machine according to claim 2, in which the nozzles are supported to inject said extra fluid along an acute angle relative to the radial direction toward the rotor axis.

4. A machine according to claim 2, in which the rotor forms part of a gas turbine.

5. A machine according to claim 1 in which the vanes are fixed relative to the rotor.

6. A turbo machine adapted for use as a compressor or a pump, comprising:

a housing provided with an inlet and an outlet;

at least one driven rotor provided with rotor vanes in said housing, by means of which a free vortex flow of fluid is displaced from the inlet to the rotor vanes without deflection by other vanes inside the housing, and then brought to a higher pressure level, and is finally discharged via the outlet;

injection means provided in the region of the inlet for injecting extra fluid into the flow of fluid from the inlet to the rotor, said injection means including a plurality of nozzles disposed in an annular array positioned concentrically with respect to the axis of the rotor at a greater distance than said rotor vanes from said axis; and a plurality of struts disposed transversely to the flow in the inlet section of the housing spaced about the axis of the rotor, said nozzles being formed by openings in feed conduits connected to the outlet of the rotor and being disposed in spaced relationship about the axis of the rotor on a smaller radius than the struts and parallel to said struts.

7. A machine according to claim 6, in which the nozzles are supported to inject said extra fluid along an acute angle relative to the radial direction toward the rotor axis.

8. A machine according to claim 6, in which the rotor forms part of a gas turbine.

9. A machine according to claim 6, in which the vanes are fixed relative to the rotor.

* * * * *